United States Patent [19]

Suzuki

[11] Patent Number: 4,645,868

[45] Date of Patent: Feb. 24, 1987

[54] ELECTRICAL TRANSMISSION LINE

[75] Inventor: Hirosuke Suzuki, Tokorozawa, Japan

[73] Assignee: Junkosha Company, Ltd., Tokyo, Japan

[21] Appl. No.: 723,521

[22] Filed: Apr. 15, 1985

[30] Foreign Application Priority Data

Apr. 18, 1984 [JP] Japan ..... 59-55977[U]

[51] Int. Cl.[4] ..... H01B 7/08

[52] U.S. Cl. ..... 174/117 F; 174/36; 174/115

[58] Field of Search ..... 174/36, 115, 117 F, 174/70 R; 333/243; 350/96.23

[56] References Cited

U.S. PATENT DOCUMENTS

| | | | |
|---|---|---|---|
| 3,219,752 | 11/1965 | Harris | 174/117 R |
| 3,688,016 | 8/1972 | Spade | 174/36 |
| 3,735,022 | 5/1973 | Estep | 174/117 F |
| 3,953,566 | 4/1976 | Gore | 264/175 X |
| 4,176,910 | 12/1979 | Noethe | 350/96.23 |
| 4,185,162 | 1/1980 | Bogese, II | 174/115 X |
| 4,220,807 | 9/1980 | Anastasi et al. | 174/117 F X |
| 4,381,208 | 4/1983 | Baverstock | 174/117 F X |
| 4,423,282 | 12/1983 | Suzuki et al. | 174/117 F X |
| 4,443,657 | 4/1984 | Hill et al. | 174/117 F X |
| 4,468,089 | 8/1984 | Brorein | 174/117 F X |

*Primary Examiner*—Arthur T. Grimley
*Assistant Examiner*—Morris H. Nimmo
*Attorney, Agent, or Firm*—Mortenson & Uebler

[57] ABSTRACT

A high speed electrical transmission line is provided comprising a plurality of elongate conductor wires arranged in parallel relationship and encased in an outer insulating covering jacket having generally a rectangular cross-section and wherein each conductor is further encased within the outer jacket in an insulating covering of a porous resin material.

4 Claims, 9 Drawing Figures

ELECTRICAL TRANSMISSION LINE

BACKGROUND OF THE INVENTION

The present invention relates to a transmission line having a short signal propagation delay time.

Heretofore, there has been proposed a transmission line as shown in FIG. 1. The transmission line 1 is made up of a signal conductor wire 2 placed at the center of the rectangular cross-section, a pair of conductors 3 placed on either side of the signal conductor 2, and an insulating resin covering jacket 4, such as polyethylene, which is called "form keeping resin material" having a rectangular cross-section. The conductor 2 and the conductors 3 are kept parallel to one another at the desired transverse separation distance. The conductors 3 act as the grounding wires for the signal conductor 2 and as mechanical reinforcement. Only one conductor 2 may suffice in some cases.

The transmission line 1 shown in FIG. 1 may be used alone or it may be used in a multiple component assembly. In the latter case, a plurality of transmission lines 1 are joined side-by-side by fusion bonding of the covering 4 so that they form a multiple flat cable 5 shown in FIG. 2. The distance between the signal conductors 2 is usually about 1.27 mm.

The conventional transmission line mentioned above has disadvantages. It has a relatively long signal propagation delay time because the electromagnetic wave resulting from signal transmission concentrates in the covering 4 made of polyethylene resin or the like. In the case of transmission line as shown in FIG. 1 employing polyethylene, the propagation delay time is about 4.7 nsec/m, and it has previously been impossible to reduce it below 4.0 nsec/m for the transmission line of this kind. For the characteristic impedance required, it is necessary that the conductors 3 be placed as far away as possible from signal conductor 2. Such an arrangement reduces the thickness of the covering 4 in the vicinity of the surface 4*a*. This can lead to insufficient dielectric strength when an electric current is applied to the conductor 3 while the transmission line is used under water, for example. Moreover, in the case of multiple component flat cable, it is necessary to keep adjacent conductors 2 away from one another.

The present device is intended to overcome the above-mentioned disadvantages inherent in the conventional transmission line of this kind, and to provide a transmission line having improved transmission characteristics. According to the device, there is provided a transmission line comprising a signal conductor, conductors placed in parallel relationship to said signal conductor, an insulating porous resin inner covering in which are enclosed said signal conductor and said conductors, and an outer covering.

Applicant's copending application U.S. Ser. No. 723,327, filed Apr. 15, 1985, discloses an electrical transmission line comprising at least one elongate signal conductor, one or more other conductors placed away from and substantially parallel to said signal conductor, all conductors encased in an outer insulating resin covering having a rectangular cross-section, the signal conductor(s) being further encased in an inner insulating porous resin covering, the porous resin covering having an electrical shielding layer thereover.

Applicant's copending application U.S. Ser. No. 723,448, filed Apr. 15, 1985, discloses a flexible cable for delivering power or force to, for example, a robot. That cable comprises at least one elongate power conductor, one or more linear reinforcing members spaced apart from and in substantially parallel relationship with the power conductor, the power conductor being encased within an inner, low-friction insulating covering, and all components further encased within an outer plastic covering having a substantially rectangular cross-section. Multiple component cables having individual components are also provided.

SUMMARY OF THE INVENTION

A high speed electrical transmission line is provided comprising a plurality of elongate conductor wires arranged in parallel relationship with each other and encased in an outer insulating covering jacket having generally a rectangular cross-section, and wherein each conductor is further encased within the outer jacket in an insulating inner covering of a porous resin material. The porous resin material is preferably expanded porous polytetrafluoroethylene. Each conductor wire can be individually encased within an inner covering of porous resin material or more than one of the conductors can be encased together in an insulating inner covering of a porous resin material. A multiple component transmission line is also provided in the form of a flat cable wherein a plurality of the aforementioned transmission lines are joined together in side-by-side relationship. The plurality of transmission lines can be joined in side-by-side relationship at discrete intervals along the longitudinal dimension of the line, leaving openings through the cable thickness between the joined regions.

DETAILED DESCRIPTION OF THE INVENTION AND PREFERRED EMBODIMENTS WITH REFERENCE TO THE DRAWINGS

A high speed electrical transmission line is provided comprising a plurality of elongate conductor wires arranged in parallel relationship and encased in an outer insulating covering jacket having generally a rectangular cross-section and wherein each conductor is further encased within the outer jacket in an insulating covering of a porous resin material.

The invention is best described in detail with reference to the accompanying drawings and the following examples.

Figure 1:
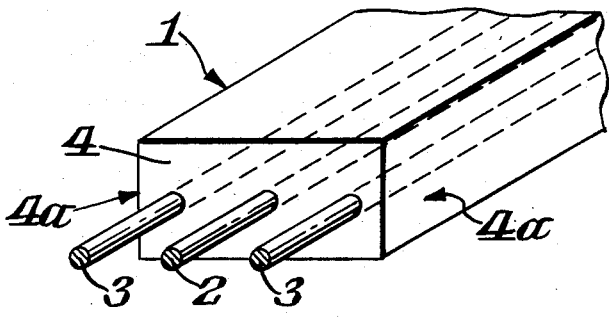
Fig. 1 (Prior Art)
FIG. 1 is a perspective view of an end of a conventional transmission line.
Figure 2:
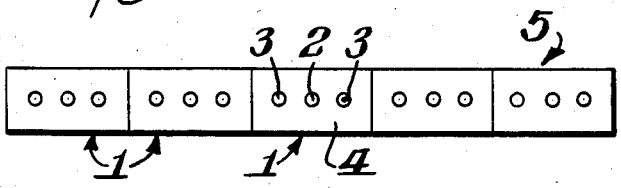
Fig. 2 (Prior Art)
FIG. 2 is an end view of a conventional multiple component flat cable formed by joining together a plurality of the individual transmission lines of FIG. 1.
Figure 3:
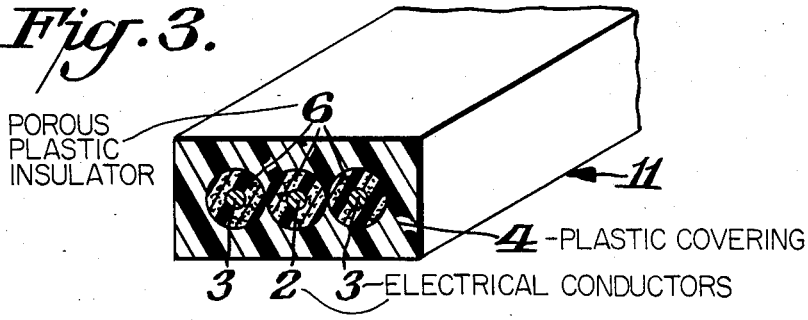
FIG. 3 is an end cross-sectional view of one embodiment of a transmission line of this invention.

FIG. 3 is an end view of an example of the transmission line of this device. The transmission line 11 comprises of a signal conductor 2, conductors 3, an insulating porous resin layer 6 which encloses and encases said conductors, and a covering 4.

The insulating porous resin layer 6 can be porous polyolefin, polyamide, polyester, or a porous fluoroplastic such as porous polytetrafluoroethylene (PTFE), tetrafluoroethylene-hexafluoropropylene copolymer (FEB) resin, tetrafluoroethylene-perfluoroalkyl-vinyl ether copolymer resin (PFA), or tetrafluoroethylene-ethylene copolymer resin (ETFE) which has been made porous by a stretching method, salt leaching method, or solvent evaporation method. A preferred polymer is porous expanded polytetrafluoroethylene (EPTFE) produced according to the process disclosed in U.S. Pat. No. 3,953,566. It is desirable because of its excellent electrical properties and low dielectric constant. In this example, the layer 6 is formed by winding PTFE resin tape around each of the conductors 2 and 3.

The EPTFE resin tape is a 0.05 mm thick expanded porous tape prepared by extruding a pasty mixture of tetrafluoroethylene resin (PTFE) fine powder and a liquid lubricant, followed by calendering and lubricant removal, to form an unsintered PTFE tape. This tape is then stretched in the longitudinal direction to three times its orginal length in an atmosphere at about 300° C. The tape is finally heated at 360° C. for 10 seconds while being kept stretched. This tape is nearly fully sintered and has a specific gravity of 0.68.

The covering 4 can be made of any resin which is capable of extrusion molding. Examples of such resins include tetrafluoroethylene resin (PTFE), tetrafluoroethylene-perfluoroalkyl-vinyl ether copolymer resin (PFA), tetrafluoroethylene-hexafluoropropylene copolymer resin (FEP), EPE resin, tetrafluoroethylene-ethylene copolymer resin (ETFE), trifluorochloroethylene resin (PCTFE), and difluorovinylidene resin (PVDF). Not only are these resins superior in electrical properties but they provide good adhesion to the signal conductor 2 and the porous resin surrounding it.

To produce the transmission line 11 shown in FIG. 3, a silver-plated soft copper wire, 0.16 mm in diameter, is provided for the signal conductor 2 and the conductors 3. Each conductor is helically wrapped with the above-mentioned EPTFE resin tape which is nearly fully sintered and has a specific gravity of 0.68. The tape-wrapped conductor is heated at 340° C. resulting in complete sintering. Thus, there is obtained an insulated conductor wire, 0.4 mm in diameter. These conductors are enclosed by extrusion molding in a covering 4 having a rectangular cross-section, measuring 1.3 mm wide and 0.7 mm thick. The insulating porous resin layer 6 can be formed around the signal conductor 2 and the conductor 3 by wrapping the conductor with a tape helically longitudinally or by extrusion of a porous material. The resin layer 6 and the covering 4 are bonded together by fusion bonding or adhesion. The transmission line 11 thus obtained has a characteristic impedance of 95 ohms and a propagation delay time of 3.8 nsec/m.

Figure 4:
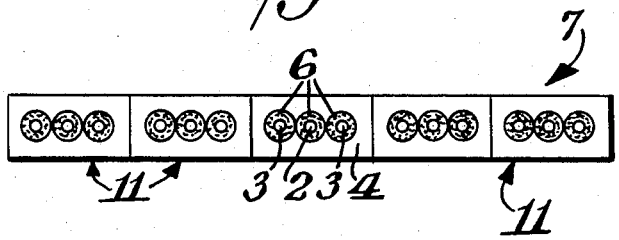
FIG. 4 is an end elevational view of a multiple component flat cable formed by joining together a plurality of the individual transmission lines shown in FIG. 3.

FIG. 4 shows a multiple flat cable 7 which is formed by joining a plurality of the transmission lines 11 as shown in FIG. 3.

Figure 5:
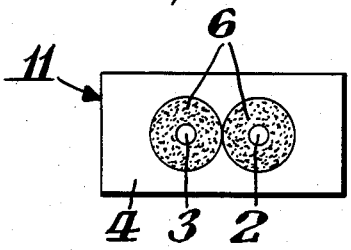
FIGS. 5–8 are end elevational views of alternate embodiments of transmission lines according to this invention.

In the transmission line of this invention, the distance between the signal conductor 2 and the conductor 3 can be reduced by about 15% and the propagation delay time is reduced by about 25% from that of conventional transmission lines having characteristic impedance 95 ohms, which has the same conductors and covering as those in the transmission line of this invention but which does not have the insulating porous resin layer 6. In addition, an improvement of about 40% is observed with regard to the distortion of pulse transmissions. In this example, two conductors 3 are arranged on either side of the signal conductor 2. A single conductor 3 may be sufficient in some cases as shown in FIG. 5.

Figure 6:
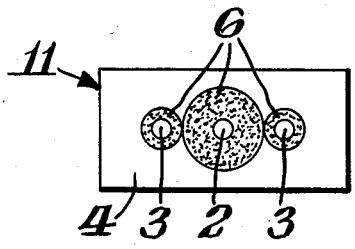

In another embodiment shown in FIG. 6 the insulating porous resin layer 6 covering the signal conductor 2 may be thicker than the resin layer 6 covering the conductors 3 arranged on either side of the signal conductor 2.

Figure 7:
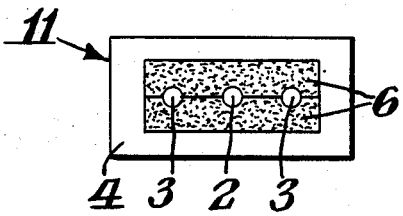

In the example shown in FIG. 7 the insulating porous resin layer 6, having a rectangular cross-section, is formed by sintering at 340° C. two pieces of comparatively thick EPTFE resin tape holding the conductors 2 and 3 between them.

Figure 8:
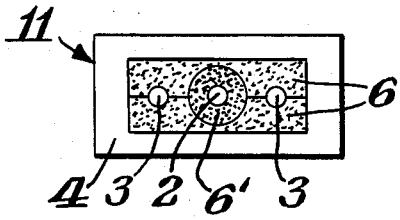

In the example shown in FIG. 8, the first insulating porous resin layer 6 is formed by winding an EPTFE resin tape around the signal conductor 2 alone, and then the resin layer 6 is formed by sintering two pieces of comparatively thick EPTFE resin tape holding the conductors 2 and 3 between, as shown in FIG. 7. This structure has improved insulation performance.

In any one of the above-mentioned examples, the insulating porous resin layer 6 may be made of the porous plastic film having a large number of additional through holes which is produced according to the process disclosed in Japanese Patent Laid-Open Publication No. 176132/1982, entitled "Sheetlike Resin Material". The resulting insulating porous resin layer 6 will have a low dielectric constant and a high compression resistance. Thus, the transmission line employing it will have improved transmission characteristics.

Figure 9:
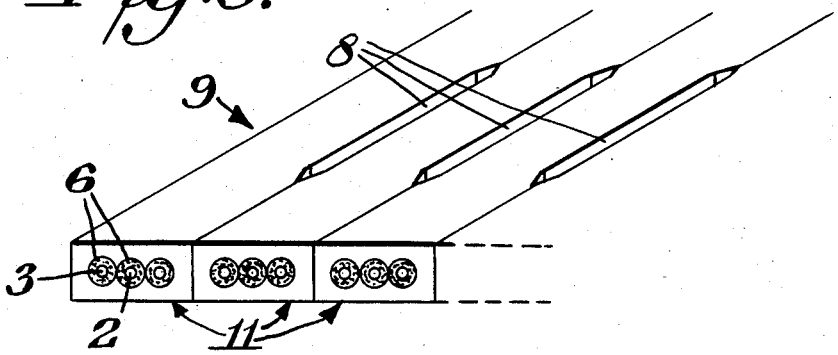
FIG. 9 is a perspective view of the end of a flat cable formed by joining a plurality of transmission lines depicted in FIG. 3 at discrete intervals along the longitudinal dimension of said cable, there being openings through the thickness of said cable between the joined regions.

A plurality of the transmission lines 11 of this device may be joined side-by-side to form a multiple flat cable 9 as shown in FIG. 9. In this case, the transmission lines may be separated from one another at desired longitudinal intervals, indicated by reference numeral 8 in FIG. 9. Such a structure has an advantage in that the individual transmission lines 11 are not subjected to unduly high tension or compression when the cable is twisted, flexed or bent.

As stated above, the transmission line of this invention has a low trans mission loss and a short propagation delay time because of the presence of the insulating porous resin layer 6 enclosing the conductors 2 and 3. Moreover it has a high transmission density owing to the decrease in distance between the conductors. Thus, this device is remarkably effective in improving the dielectric strength, dimensional stability, and processability of the transmission line.

According to this invention, the insulating porous resin layer 6 encloses both the signal conductor 2 and the conductors 3. It would be possible to reduce the propagation delay time even when the insulating porous resin layer 6 is formed around the signal conductor 2 alone. In such a structure, however, the conductor 3 which is used as a grounding wire is in direct contact with the covering 4. This would increase the composite dielectric constant, causing electromagnetic waves to concentrate in the covering 4 and adversely affect the transmission characteristics. These problems have been solved by the present invention wherein both the signal conductor 2 and the ground wires 3 are encased in the porous resin, resulting in a combined permittivity between signal conductor 2 and conductors 3 so reduced that the transmission characteristics are improved.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A high speed electrical transmission line comprising an elongated signal conductor wire arranged in parallel relationship with two ground wires, one on either side of said signal conductor wire, all three wires being encased in an outer nonporous insulating covering jacket having generally a rectangular cross-section, and wherein each said wire is further individually encased within the outer jacket in an insulating inner covering of a porous resin material, wherein said porous resin has, in addition to the pores in the resin, a large number of through holes.

2. The transmission line of claim 1 wherein said porous resin material is expanded porous polytetrafluoroethylene.

3. A multiple component transmission line in the form of a flat cable wherein a plurality of unit transmission lines are joined together in side-by-side relationship wherein each unit transmission line comprises an elongated signal conductor wire arranged in parallel relationship with two ground wires, one on either side of said signal conductor wire, all three wires being encased in an outer nonporous insulating covering jacket having generally a rectangular cross-section, wherein each said wire is further individually encased within the outer jacekt in an insulating inner covering of a porous resin material, wherein said porous resin has, in addition to the pores in the resin, a large number of through holes.

4. The multiple component transmission line of claim 3 wherein said plurality of transmission lines are joined in side-by-side relationship at discrete intervals along the longitudinal dimension of said line.

* * * * *